US005614327A

United States Patent [19]

Morello

[11] Patent Number: 5,614,327

[45] Date of Patent: Mar. 25, 1997

[54] PROCESS FOR PROTECTING A SILVER OR SILVER-COATED PART

[75] Inventor: Richard Morello, Annecy-Le-Vieux, France

[73] Assignee: Sarthoise De Revetements Electrolytiques, Marolles-Les-Braults, France

[21] Appl. No.: 558,937

[22] Filed: Nov. 13, 1995

Related U.S. Application Data

[63] Continuation of Ser. No. 303,507, Sep. 9, 1994, abandoned.

[51] Int. Cl.[6] ..... B32B 15/00; C25D 3/58; C25D 11/38

[52] U.S. Cl. ..... 428/632; 428/673; 428/674; 428/935; 205/241; 205/176

[58] Field of Search ..... 428/673, 674, 428/935, 926, 632; 205/241, 319, 240, 170, 176

[56] References Cited

U.S. PATENT DOCUMENTS

| | | | |
|---|---|---|---|
| 1,779,809 | 10/1930 | Gray et al. | 428/673 |
| 1,850,997 | 3/1932 | Assmann | 428/673 |
| 1,947,180 | 2/1934 | Bart | 428/673 |
| 2,435,967 | 2/1948 | Jernstedt | 205/241 |
| 2,436,316 | 2/1948 | Lum et al. | 205/241 |
| 2,530,967 | 11/1950 | Jernstedt | 205/241 |
| 3,419,364 | 12/1968 | Pryor et al. | 428/673 |
| 3,687,713 | 8/1972 | Adams | 428/673 |
| 3,778,237 | 12/1973 | Shapiro et al. | 428/673 |
| 4,496,438 | 1/1985 | Helton et al. | 205/241 |

FOREIGN PATENT DOCUMENTS

| | | | |
|---|---|---|---|
| 1097672 | 7/1955 | France | 428/673 |
| 1040339 | 10/1958 | Germany | 205/241 |
| 58-55587 | 4/1983 | Japan | 205/241 |
| 680937 | 10/1952 | United Kingdom | 205/241 |

OTHER PUBLICATIONS

J.B. Mohler, "Copper–Tin–Zinc Plating", Metal Finishing, Oct. 1955, p. 47.

W.H. Safranek et al., "Copper–Tin Alloy Plating", Plating, vol. 41, No. 10, Oct. 1954, pp. 1159–1164, 1169–1170.

*Primary Examiner*—John Zimmerman

*Attorney, Agent, or Firm*—Young & Thompson

[57] ABSTRACT

A process for protecting, especially against corrosion, a silver or silver-coated part, wherein a Cu—Sn alloy comprising from 53 to 75% copper and from 25 to 47% tin and optionally comprising up to 10% zinc is deposited on the said part over a thickness of less than 0.01 μm. Another aspect of the invention is a silver or silver-coated part additionally having a protective coating formed from a Cu—Sn or Cu—Sn—Zn alloy, with a thickness of less than 0.01 μm.

6 Claims, 1 Drawing Sheet

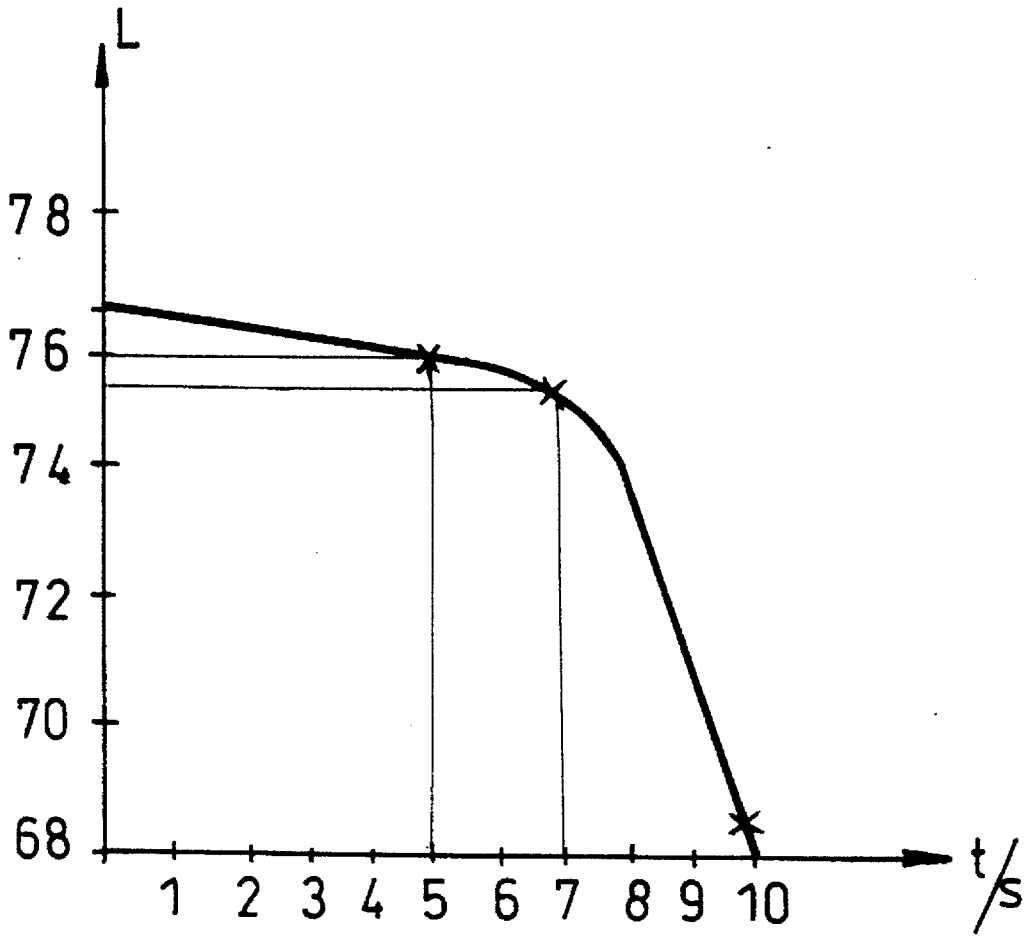
L
78
76
74
72
70
68
1
2
3
4
5
6
7
8
9
10
t/s

PROCESS FOR PROTECTING A SILVER OR SILVER-COATED PART

This application is a continuation of application Ser. No. 08/303,507, filed Sep. 9, 1994, now abandoned.

FIELD OF THE INVENTION

The invention relates to a process for protecting a silver or silver-coated part.

BACKGROUND OF THE INVENTION

Silver or silver-plated metal is very sensitive to corrosion, especially by the sulphur-containing compounds often present in the atmosphere.

Processes for protecting such parts must be effective for a prolonged period of time while preserving the white appearance of the silver.

Various processes intended to protect these silver or silver-plated parts are known, such as chromating or applying a varnish.

Processes intended to protect silver are also known which consist in applying a rhodium or platinum coating.

Mention is made, among protective coatings based on non-noble metals, of the deposition of tin.

Thus, FR 1,097,672 describes an electrolytic deposition of tin in which the tin is deposited from an acidic alcoholic or aqueous solution additionally containing Cd, Zn, Al, Ag, Au or Pt.

Moreover, it is known to deposit coatings composed of a Cu—Sn—Zn alloy on nickel or copper or nickel-coated or copper-coated parts in order to confer the appearance of silver on the final product obtained. However, in this case, the deposition time is relatively long in order to confer a sufficient thickness on the Cu—Sn—Zn coating in order to completely mask the underlying metal and to imitate the "whiteness" of silver.

SUMMARY OF THE INVENTION

It has now been discovered that it was possible to obtain excellent protection of silver or silver-coated parts by depositing a flash coating of a Cu—Sn alloy, optionally comprising zinc, on the part.

The thickness of the Cu—Sn—(Zn) coating obtained must be relatively low in order not to detrimentally affect the color of the silver and to make possible subsequent passivation of the silver, while having a sufficient thickness to protect the surface of the part to be coated against corrosion.

The subject of the present invention is thus a process for protecting, especially against corrosion, a silver or silver-coated part, characterized in that a Cu—Sn alloy comprising from 53 to 75% by weight of copper and from 25 to 47% by weight of tin and optionally comprising up to 10% by weight of zinc is deposited on the said part over a thickness of less than 0.01 μm.

The flash coating consisting of a Cu—Sn—(Zn) alloy can be obtained by electrolytic deposition, cathodic spraying under vacuum or any other known process which makes it possible to deposit a very fine coating on a metal part.

The flash coating consisting of a Cu—Sn—(Zn) alloy is advantageously obtained by electrolytic deposition in cyanide medium by means of an aqueous alkaline bath comprising from 0.6 to 10 g/l and preferably 3 to 8.5 g/l of $Cu^+$ ions, from 0.6 to 10 g/l and preferably from 6 to 10 g/l of $Sn^{2+}$ ions, from 0 to 3 g/l and preferably from 2 to 3 g/l of $Zn^{2+}$ ions and from 6 to 50 g/l of $CN^-$ ions, at a temperature between approximately 40° C. and approximately 70° C., with a current density between approximately 0.5 A/dm$^2$ and approximately 3 A/dm$^2$, for a period of time of between 4 and 8 seconds.

Advantageously, an electrolytic chromating of the part thus coated is additionally carried out.

The aqueous electrolytic bath advantageously additionally contains a stabilizer and a lead-based brightener.

The amount of stabilizer is preferably between 30 and 50 g/l.

Due to the presence of lead in the brightener, the Cu—Sn—(Zn) alloy can comprise traces of lead.

The pH of the bath is at least 12 and is adjusted by means of a strong base such as sodium hydroxide or potassium hydroxide. The alkaline aqueous bath contains, for example, from 10 to 15 g/l of potassium hydroxide.

The chromating is carried out under standard conditions, preferably using a chromating bath containing chromate ions at a concentration of between 5 and 10 g/l, expressed as chromic acid.

The duration of the chromating is preferably approximately one minute at room temperature, current density being approximately 1 A/dm$^2$.

Another subject of the invention is a silver or silver-coated part additionally containing a protective coating formed from a Cu—Sn or Cu—Sn—Zn alloy, with a thickness of less than 0.01 μm.

BRIEF DESCRIPTION OF THE DRAWING

The accompanying drawing is a graph of whiteness of a coated article, versus flash plating time.

DETAILED DESCRIPTION OF THE INVENTION

An implementational example of the process of the invention will be described below.

EXAMPLE

A Cu—Sn—Zn alloy is deposited on a silver-coated part, obtained by carrying out a standard electrolytic silver-plating in a bath at room temperature containing 36 g/l of silver cyanide and 60 g/l of potassium cyanide with a current density of 1 A/dm$^2$, using a bath having the following composition:

potassium cyanide: 100 g/l,
$Cu_2(CN)_2$: 10 g/l, i.e. 7.1 g/l of $Cu^+$ ions,
potassium stannate, giving 10 g/l of $Sn^{++}$ ions,
$Zn_2(CN)_2$, giving 2.25 g of $Zn^{++}$ ions,
brightener (Platinor 2000): 5 cm$^3$/l
stabilizer: 40 g/l,
KOH: 15 g/l,
$H_2O$: balance,
under the following conditions:
temperature: 60° C.,
current density: 1 A/dm$^2$,
deposition time: 6 seconds.

The part thus coated is treated by immersion coating in a chromating solution available under the tradenee RN 1709, 75 g/l, for one minute with a current density of 1 A/dm$^2$ at room temperature.

The coating obtained has the white appearance of silver while introducing excellent resistance to corrosion, even after several months.

The properties of the parts obtained by the process of Example 1 while varying the deposition times of the Cu—Sn—Zn alloy will be described below.

1—Whiteness of the coating.

The whiteness measurements were carried out with a chromometer which makes it possible to determine the value of the brightness (whiteness) as a function of the mass of the alloy deposited, expressed by the deposition time.

The deposition times vary from 1 to 10 seconds.

The results are represented in the appended figure representing the curve obtained by plotting the deposition time of the Cu—Sn—Zn alloy on the abscissae and the "whiteness" obtained L on the ordinates.

The results show that an excellent "whiteness" is observed for times of less than 8 seconds, which decreases rapidly when the deposition time reaches 7 to 8 seconds, the fall in whiteness probably being due to the underlying silver being completely covered.

2—Corrosion tests

The following corrosion tests, representative of the chemical attacks to which the silver metal or silver-plated parts may be subjected, are carried out:

1) Test with ammonium hydrogensulphite.

10 ml of the solution are placed at room temperature in a closed chamber of approximately 4 liters in the presence of the samples to be studied. The samples are examined for damage after a few hours (attack of sulphur dioxide gas).

2) Test with sodium sulphide.

A drop of 1% sodium sulphide solution is deposited on an absorbent paper in contact with the part to be studied.

3) Test with neutral sweat (Oelsner and E/Ze solution).

A drop of solution is deposited on an absorbent paper in contact with the part to be studied.

The formula of the solution is the following:

Sodium chloride 4.0 g/l
Urea 1.0 g/l
Ammonium chloride 3.5 g/l
Lactic acid 3.0 ml/l
Butyric acid 1.0 ml/l
Acetic acid 0.5 ml/l
Propanoic acid 0.5 ml/l 4) Test with moist warmth.

The parts are placed for at least 12 hours in a chamber at 38° at 95% relative humidity.

5) Test with thioacetamide.

This test is standardized ISO 4538–1978 F.

A thioacetamide charge in an atmosphere with a controlled humidity produces corrosion on the parts arranged in a closed chamber. The results are observed after several hours of exposure.

The results are reported in the table below:

TABLE

| TESTS | (1) | (2) | (3) |
|---|---|---|---|
| Ammonium hydrogen-sulphite | no detrimental change | matt veil | no detrimental change |
| Sodium sulphide | very slight detrimental change | large detrimental change | large detrimental change |
| Neutral sweat | no detrimental change | modest detrimental change | modest detrimental change |
| Moist warmth | no detrimental change | no detrimental change | no detrimental change |
| Thioacetamide ISO 4538 1978 F | no detrimental change | — | — |

(1) Silver part containing a coating according to the invention obtained after 5 seconds of deposition, followed by a chromating.
(2) Silver part containing a coating according to the invention obtained after 10 seconds, without chromating.
(3) Silver part containing a coating according to the invention obtained after 10 seconds, followed by a chromating.

It clearly appears, from the results, that a flash coating according to the invention, preferably obtained by following the deposition of the alloy with a chromating, affords excellent resistance to the various corrosion tests.

I claim:

1. Method for protecting, against corrosion, a silver or silver-coated part, comprising:

a first step of electrolytically depositing on the said part a flash coating of a Cu—Sn—(Zn) alloy comprising from 53 to 75% by weight of copper, from 25 to 47% by weight of tin and from 0 to 10% by weight of zinc, the thickness of said coating being of less than 0.01 μm, and a second step of an electrolytic chromating of the part previously coated with said alloy.

2. Method for protecting, against corrosion, a silver or silver-coated part, comprising:

a first step of electrolytically depositing on the said part a flash coating of a Cu—Sn—(Zn) alloy in cyanide medium by means of an aqueous alkaline bath comprising:

from 0.6 to 10 g/l of $Cu^+$ ions, from 0.6 to 10 g/l of $Sn^{2+}$ ions, from 0 to 3 g/l of $Zn^{2+}$ ions, and from 6 to 50 g/l of $CN^-$ ions, at a temperature between approximately 40° C. and approximately 70° C., with a current density between approximately 0.5 A/dm$^2$ and approximately 3 A/dm$^2$, for a time of between 4 and 8 seconds, and a second step of an electrolytic chromating of the part previously coated with said alloy.

3. Method according to claim 2, wherein said aqueous alkaline bath comprises:

from 3 to 8.5 g/l of $Cu^+$ ions, from 6 to 10 g/l of $Sn^{2+}$ ions, from 2 to 3 g/l of $Zn^{2+}$ ions, and from 6 to 50 g/l of $CN^-$ ions.

4. Method according to claim 2, wherein the aqueous alkaline bath further contains from 10 to 15 g/l of potassium hydroxide.

5. Method according to claim 2, wherein the aqueous alkaline bath further contains a lead-based brightener.

6. Silver or silver-coated part additionally containing a protective coating formed from a Cu—Sn—(Zn) alloy, comprising from 53 to 75% by weight of copper, from 25 to 47% by weight of tin and from 0 to 10% by weight of zinc, the alloy coating having a thickness of less than 0.01 μm, wherein said alloy coating has been subjected to an electrolytic chromating.

* * * * *